US008495899B2

(12) United States Patent
Gartner

(10) Patent No.: US 8,495,899 B2
(45) Date of Patent: Jul. 30, 2013

(54) ELECTROMECHANICAL LOCK

(75) Inventor: Klaus W. Gartner, Palos Verdes Estates, CA (US)

(73) Assignee: Klaus W. Gartner, Palos Verdes Estates, CA (US)

( * ) Notice: Subject to any disclaimer, the term of this patent is extended or adjusted under 35 U.S.C. 154(b) by 102 days.

(21) Appl. No.: 13/113,466

(22) Filed: May 23, 2011

(65) Prior Publication Data

US 2012/0297842 A1 Nov. 29, 2012

(51) Int. Cl.

| | |
|---|---|
| ***E05B 49/00*** | (2006.01) |
| ***E05B 65/06*** | (2006.01) |
| ***E05B 51/00*** | (2006.01) |
| ***E05B 47/00*** | (2006.01) |
| ***E05B 47/06*** | (2006.01) |

(52) U.S. Cl.

USPC ..... 70/278.1; 70/104; 70/129; 70/133; 70/275; 70/278.4; 70/280; 70/281; 70/282; 70/283

(58) Field of Classification Search

USPC ..... 70/278.1, 104, 129, 133, 275, 278, 70/0.4, 278.6, 278.7, 280–283

See application file for complete search history.

(56) References Cited

U.S. PATENT DOCUMENTS

| | | | | |
|---|---|---|---|---|
| 722,258 | A * | 3/1903 | Sines | 70/275 |
| 1,124,666 | A * | 1/1915 | Ofeic | 70/283 |
| 3,733,861 | A * | 5/1973 | Lester | 70/153 |
| 4,784,415 | A * | 11/1988 | Malaval | 292/144 |
| 5,307,656 | A * | 5/1994 | Gartner et al. | 70/277 |
| 5,473,922 | A * | 12/1995 | Bair et al. | 70/416 |
| 6,098,433 | A * | 8/2000 | Maniaci | 70/278.1 |
| 6,212,923 | B1 * | 4/2001 | Clark | 70/416 |
| 6,502,438 | B1 * | 1/2003 | Miller et al. | 70/303 A |
| 6,584,817 | B1 * | 7/2003 | Lien | 70/277 |
| 6,655,180 | B2 * | 12/2003 | Gokcebay et al. | 70/432 |
| 6,813,916 | B2 * | 11/2004 | Chang | 70/257 |
| 7,051,561 | B2 * | 5/2006 | Moon et al. | 70/283.1 |
| 7,818,984 | B2 * | 10/2010 | Hwang | 70/107 |
| 8,228,030 | B2 * | 7/2012 | Pukari et al. | 320/114 |
| 8,261,586 | B2 * | 9/2012 | Gartner | 70/277 |
| 8,302,438 | B2 * | 11/2012 | Lui | 70/277 |
| 8,316,674 | B2 * | 11/2012 | Kowalczyk | 70/277 |
| 2010/0000274 | A1 * | 1/2010 | Viso Cabrera et al. | 70/278.7 |

FOREIGN PATENT DOCUMENTS

| | | | |
|---|---|---|---|
| DE | 3412136 | A1 * | 10/1985 |
| EP | 148701 | A2 * | 7/1985 |
| FR | 2589929 | A1 * | 5/1987 |

* cited by examiner

*Primary Examiner* — Christopher Boswell

*Assistant Examiner* — Eric Kurilla

(74) *Attorney, Agent, or Firm* — Barbara A. Wrigley; Oppenheimer Wolff & Donnelly LLP

(57) ABSTRACT

An electromechanical lock comprises a housing, a rectilinear locking lever slidable within the housing, a blocking element positioned adjacent the locking lever that is movable between a first position that engages with the locking lever and a second position that disengages with the locking lever, and an actuating device operable to control movement of the blocking element between the first and second positions.

16 Claims, 8 Drawing Sheets

ELECTROMECHANICAL LOCK

BACKGROUND OF THE INVENTION

1. Field of the Invention

This invention relates to an improved electronic lock for securing goods and areas requiring a high degree of security. More particularly, this invention relates to an electronic lock that can be locked and unlocked electronically.

2. Description of the Related Art

Safes and other secure containers have traditionally used combination locks for controlling and authorizing entry. Conventional locks were mechanical and relied on a person dialing a correct combination on a rotating dial. The rotation positioned mechanical elements within the lock such that dialing the correct combination allowed a locking bolt to release the container door. Proper dial rotation aligned gates in tumblers. Once the gates were aligned, a fence on a fence lever entered the aligned gates. Continued rotation of the dial and tumblers pulled the fence lever and withdrew the bolt.

However, over the years electromechanical locks have gradually replaced the mechanical locks described above. Indeed, electromechanical locks themselves have seen many improvements over the years. The use of sophisticated electronic logic circuitry has enabled the implementation of a series of complex and unique electronic combinations which has made improper entry into secured areas more difficult. When the lock is used to secure entry to a container, the electronic components are typically mounted within a housing inside the container door. The housing contains an actuating device and a circuit board. The electronic key pad transmits a signal to the circuit board, which contains the electronic circuitry that allows the lock to open and close. The keypad is located on the outside of the housing so as to be accessible to the user. A cable typically extends between the keypad and the circuit board for transmitting signals between the two components.

In addition to the electronic circuitry, electromechanical locks include a bolt. The bolt is movably constructed and is coupled to a bolt-displacing device enabling a user to selectively move the bolt into one of at least two end positions by means of the actuating device. The lock is blocked and therefore "locked" in a first end position of the bolt and unblocked or "open" and "unlocked" in a second end position of the bolt. When the user enters the correct combination into the electronic keypad, a signal is transmitted to the circuit board. The circuit board in turn actuates the actuating device, which allows the locking bolt to move to the unlocked position within the housing, thus allowing the user to open the safe door.

There are two types of bolts, rotary bolts and rectilinear bolts. In particular, rectilinear bolt locking devices mount a bolt within a housing for moving between locked and unlocked positions. Thus, instead of pivoting like rotary bolts, linear bolts slide into and out of the locking device housing. When the user enters the correct combination, the lock mechanism releases thus allowing the locking bolt to slide into the housing.

Although known electronic safety locks have proven effective in everyday practical use, there is a need for improvement, particularly with regard to design. In known electronic locks, the interaction of the bolt and the blocking member is mechanically quite complex thus requiring complicated and expensive mounting. In addition, most electronic locks require the consumption of a great deal of energy causing frequent replacement of the power source. When the correct combination is entered, a signal is given to an actuator move the locking mechanism into the open position. The actuator causes the locking mechanism to remain open for a period of time after which the signal to re-lock is automatically triggered. Thus, known electronic locks typically require the consumption of excess energy.

BRIEF SUMMARY OF THE INVENTION

The present invention addresses the foregoing problems by providing an electronic lock which has a simplified mechanical design regarding the interaction of the bolt and blocking member. In addition, the present design does not require the consumption of a great deal of energy and results in a power source that needs to be replaced infrequently.

The present invention provides an electromechanical lock that includes a housing, a rectilinear locking lever slidable within the housing, a blocking element positioned adjacent the locking lever that is movable between a first position that engages with the locking lever and a second position that disengages with the locking lever, and an actuating device operable to control movement of the blocking element between the first and second positions.

The present invention also provides a method of opening an electromechanical lock that includes the steps of providing an electromechanical lock comprising a housing, a locking lever slidable within the housing, a blocking element movable between a first position that engages with the locking lever and a second position that disengages with the locking lever, and an actuating device operable to control movement of the blocking element, entering a combination into a key pad, transmitting a signal to a circuit board operably coupled to the electromechanical lock indicating the entered combination, operating the actuating device to move the blocking element from the first position to the second position upon entry of a correct combination, and rotating a lock dial to retract the locking lever.

Other objects, advantages and capabilities of the present invention will become apparent from the following detailed description, taken in conjunction with the accompanying drawings illustrating one embodiment of the invention.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

Figure 1A:
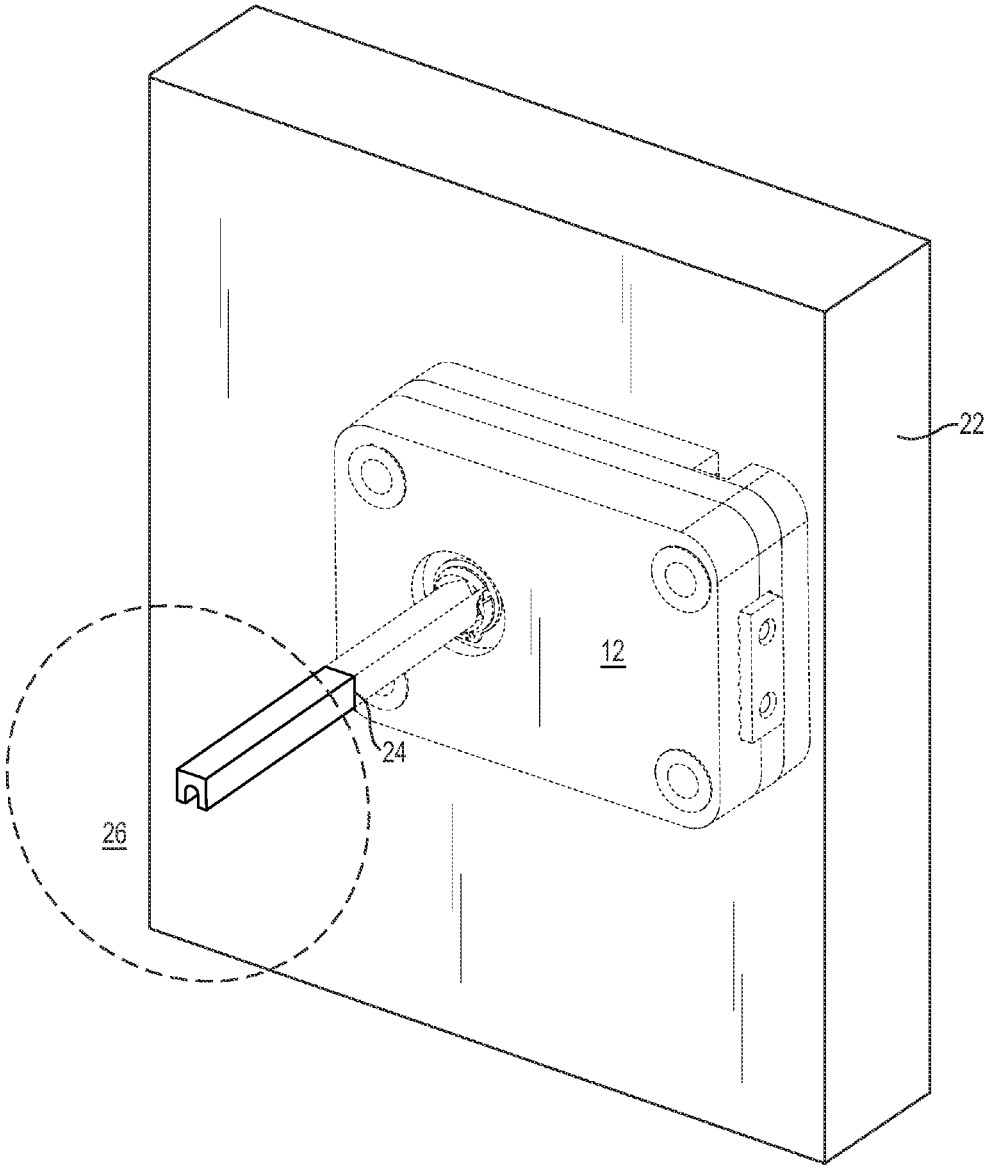
FIG. 1A is a perspective view of an electromechanical lock mounted to a container wall.
Figure 1B:
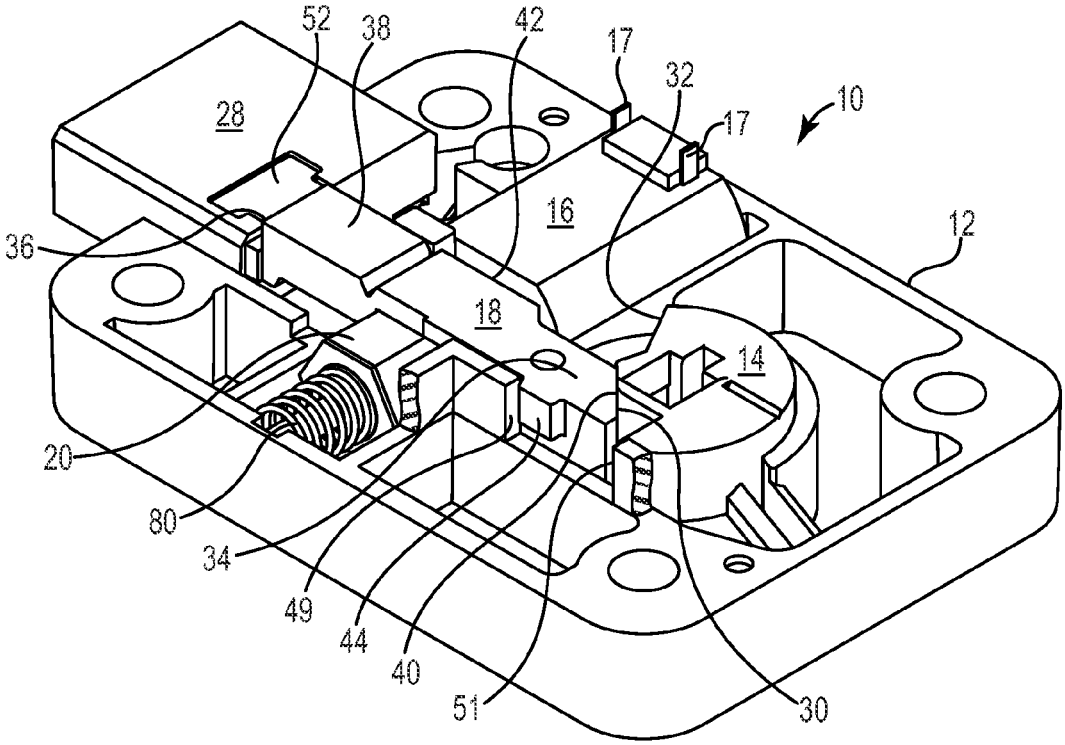
FIG. 1B is a perspective view of the electromechanical lock in accordance with an aspect of the invention depicting the locking bolt in the locked position.

Referring now to FIGS. 1A and 1B, an exemplary embodiment of an electromechanical lock is depicted with FIG. 1B depicting the lock in the lock position. Electromechanical lock 10 broadly includes housing 12, cam 14, actuating device 16, locking lever 18, and blocking element 20. Locking lever 18 and blocking element 20 together comprise the locking mechanism 19 of the invention. Actuating device 16 may be a rotary motor or like alternatives known to those of ordinary skill in the art. Housing 12 is mounted to wall 22. Wall 22 is representative of the door of a safe, container or secure room. Shaft 24 operably engages cam 14 and extends through wall 22 where it mates with electronic dial 26. When a combination is input into electronic dial 26 a signal is transmitted to a circuit board located within the housing which recognizes the combination as correct or incorrect. If the combination is the correct combination, a signal is sent to actuating device 16 via contact points 17, which in turn causes blocking element 20 to move into the unlocked position or in other words into a position in which the locking lever is no longer "blocked." This allows the operator to turn dial 26 which in turn causes cam 14 to rotate thereby allowing rectilinear bolt 28 to retract as will be hereinafter be explained in detail.

Figure 2A:
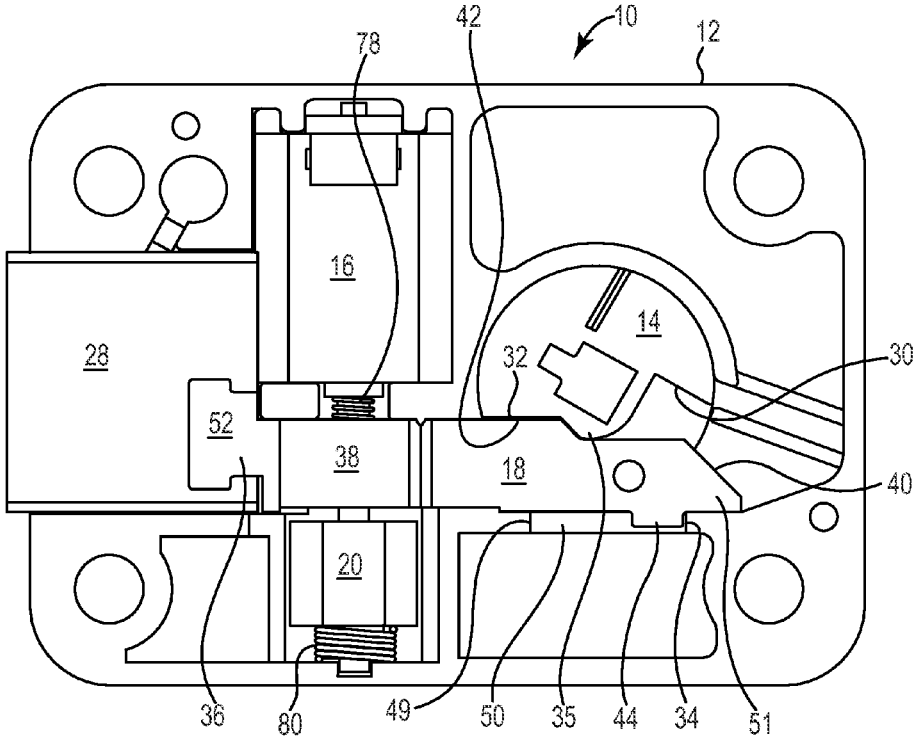
FIG. 2A is a top view of the electromechanical lock in accordance with one aspect of the invention depicting the locking bolt in the unlocked position.
Figure 2B:
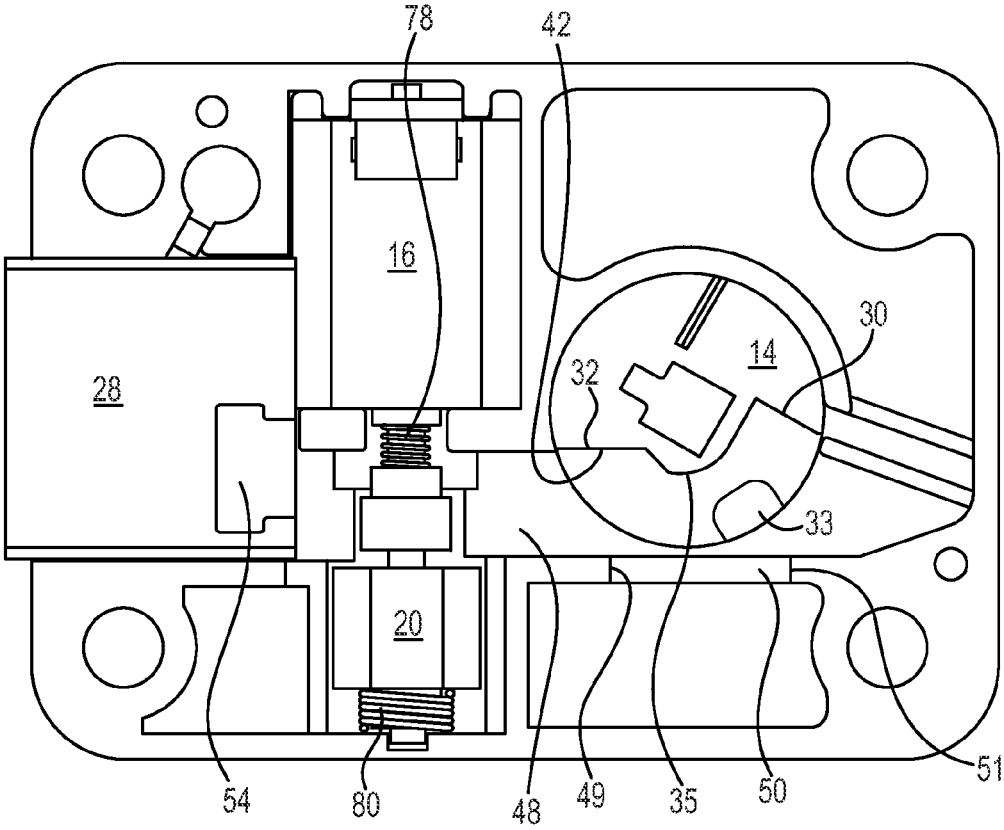
FIG. 2B is a top view of the electromechanical lock in accordance with one aspect of the invention with the locking lever removed to show detail and depicting the locking bolt in the unlocked position.

FIG. 2A is a top view of electromechanical lock 10 in accordance with an embodiment of the invention depicting electromechanical lock 10 in the open position. Referring to FIGS. 2A and 2B, cam 14 includes first blocking side 30, second blocking side 32 and projection 33. Locking lever 18 broadly includes a first cam end 34, second lock end 36 and intermediate blocking portion 38. First cam end 34 includes angled side 40. In the locked position, angled side 40 of first cam end 34 matingly abuts first blocking side 30 of cam 14. After the correct combination is entered by the operator or user and blocking element 20 moves axially forward (as will be explained in detail below), the operator manually rotates dial 26. Manual rotation of dial 26 causes shaft 24 to rotate cam 14. The rotation of cam 14 causes first blocking side 30 to disengage from the angled side 40 of first cam end 34. As locking lever 18 retracts, second blocking side 32 rotates to matingly abut side facing 42 of locking lever 18 thus allowing locking lever 18 to freely retract into housing 12 as will be explained in additional detail below.

First cam end 34 includes tab 44 which is positioned in slot 50 formed by housing 12. Slot 50 includes first and second blocking side walls 49, 51, respectively. In the locked position (FIG. 1B), tab 44 is blocked from further movement by first wall 49 thus preventing locking lever 18 from moving further. In the unlocked position (FIGS. 2A-2B), tab 44 abuts second wall 51 and blocks locking lever 18 from retracting further into housing 12.

Figure 3A:
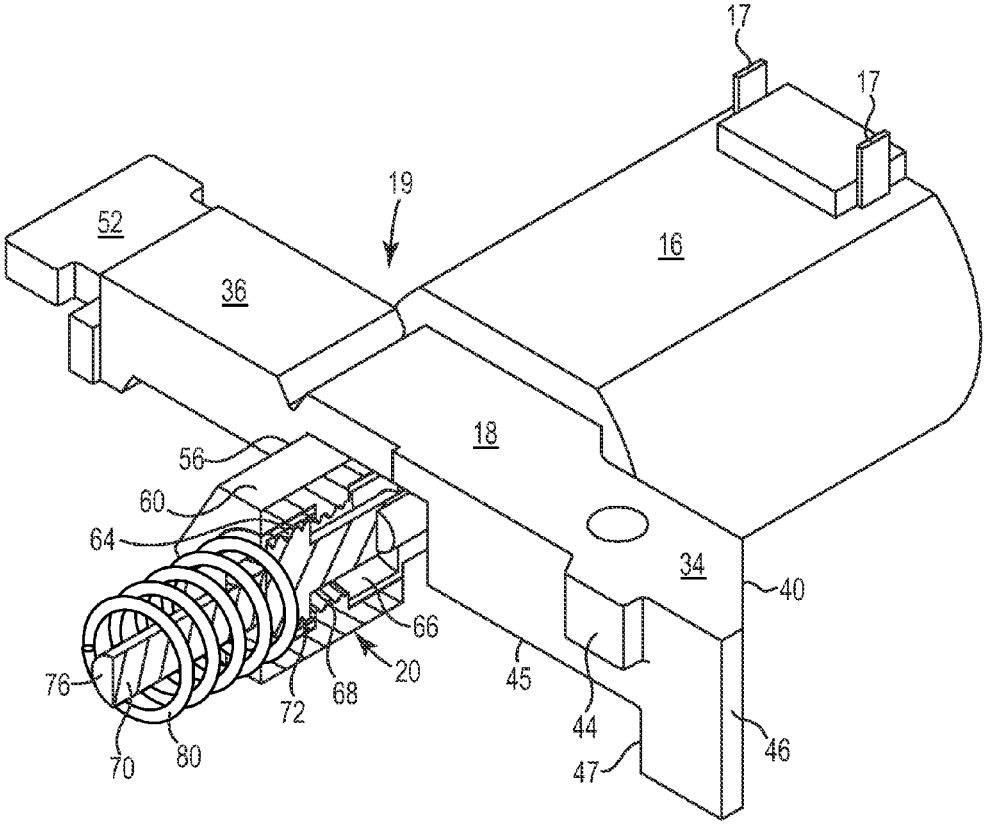
FIG. 3A is a perspective view of one aspect of the locking mechanism of the invention depicted in the locked position.

As best seen in FIG. 3A, locking lever 18 includes post 46 operably coupled at first cam end 34. Post 46 extends vertically downward from first cam end 34 and defines post face 47. As best seen in FIG. 2B (with locking lever 18 removed), housing 12 defines a recess 48 into which post 46 is slidingly received. Recess 48 permits post 46 of locking lever 18 to freely slide in housing and retract into the "unlocked" or "open" position as cam 14 is rotated to open electromechanical lock 10. Cam projection 33 (as best seen in FIG. 1B) slidingly abuts generally flat underside 45 of locking lever 18 and engages post 46 at post face 47. After the correct combination is entered by the operator or user and blocking element 20 moves axially forward into the unblocked position, the operator manually rotates dial 26. Manual rotation of dial 26 causes shaft 24 to rotate cam 14. The rotation of cam 14 causes cam projection 33 to engage post 46 at post face 47. First blocking side 30 disengages from angled side 40 of first cam end 34 to allow retraction of locking lever 18 into housing 12 as cam projection 33 continues to "pull" locking lever 18 into the open position. As locking lever 18 retracts into housing 12, second blocking side 32 rotates to matingly abut side facing 42 while rounded cam hub 35 of cam 14 matingly engages notched portion 43 of locking lever 18. Tab 44 engagingly abuts second wall 51 and stops locking lever 18 from retracting further into housing 12. Locking lever 18 in now retracted into housing 12 and rectilinear lock 28 is now in the open or unlocked position.

Referring now to FIGS. 1 through 4, second lock end 36 of locking lever 18 includes key element 52 that matingly couples with a key receiving recess 54 defined in rectilinear locking bolt 28. Those of ordinary skill in the art will appreciate that key element 52 may fixedly couple or detachably couple with key receiving recess 54 of rectilinear locking bolt 28. For ease of servicing and/or repairing electronic lock 10, however, those of ordinary skill in the art will appreciate that it is convenient to detachably couple key element 52 with key receiving recess 54.

FIG. 3A is a perspective view of the locking mechanism 19 of the invention coupled to actuation device 16 showing the locking mechanism 19 in the locked position. Locking mechanism 19 broadly includes locking lever 18 and blocking element 20. Blocking element 20 includes multiple angled sides and may be hexagonal in shape. Those of ordinary skill in the art will appreciate, however, that blocking mechanism 20 may include any number of angled sides so long as it includes at least one angled side capable of matingly engaging with angled portion 56 of locking lever 18 in the locked position. Top side 60 of blocking element 20 lays matingly adjacent underside 62 of locking lever 18 in the locked position.

Figure 3B:
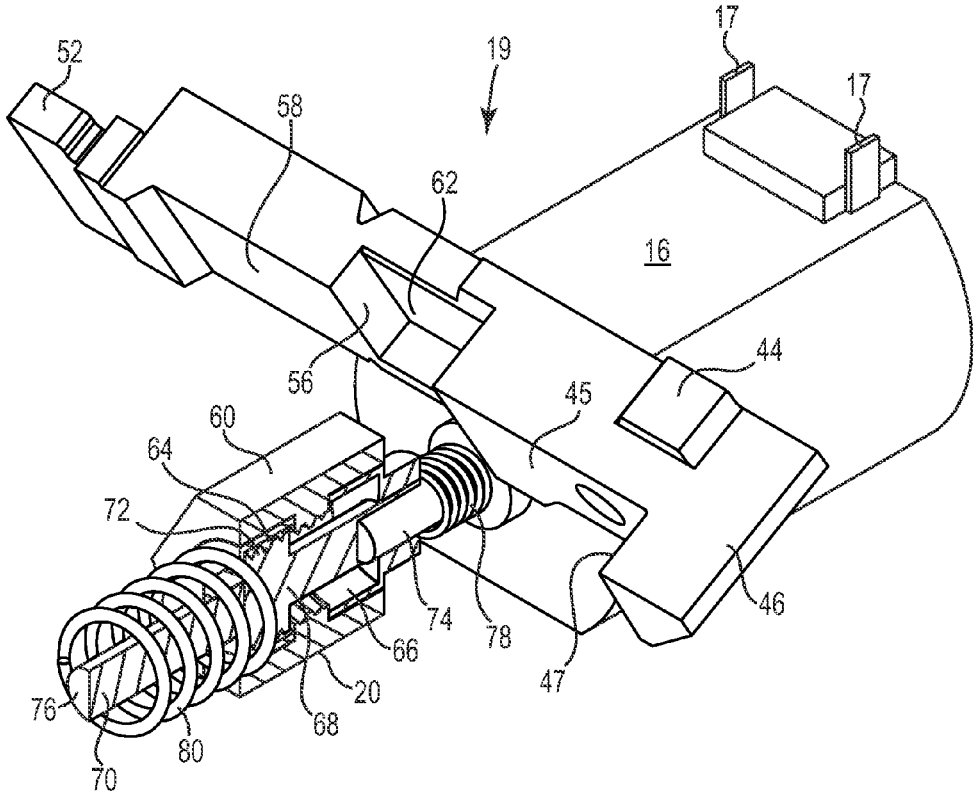
FIG. 3B is a perspective view of one aspect of the locking mechanism of the invention showing the underside of the locking lever.

As best seen in FIG. 3B, second lock end 36 of locking lever 18 includes angled portion 56 on an underside thereof. Angled portion 56 engagingly abuts a side of blocking element 20 in the locked position. Second lock end 36 may include a generally flat underside portion 58 that allows locking lever 18 to move past blocking element 20 in the unlocked position as will be explained in detail hereinafter. Although portion 56 is illustrated and described as an angled surface, one of ordinary skill in the art will appreciate that any surface configuration that is structured to abut the blocking element and prevent linear sliding movement of the blocking element may be used without departing from the intended scope of the present invention.

Figure 4:
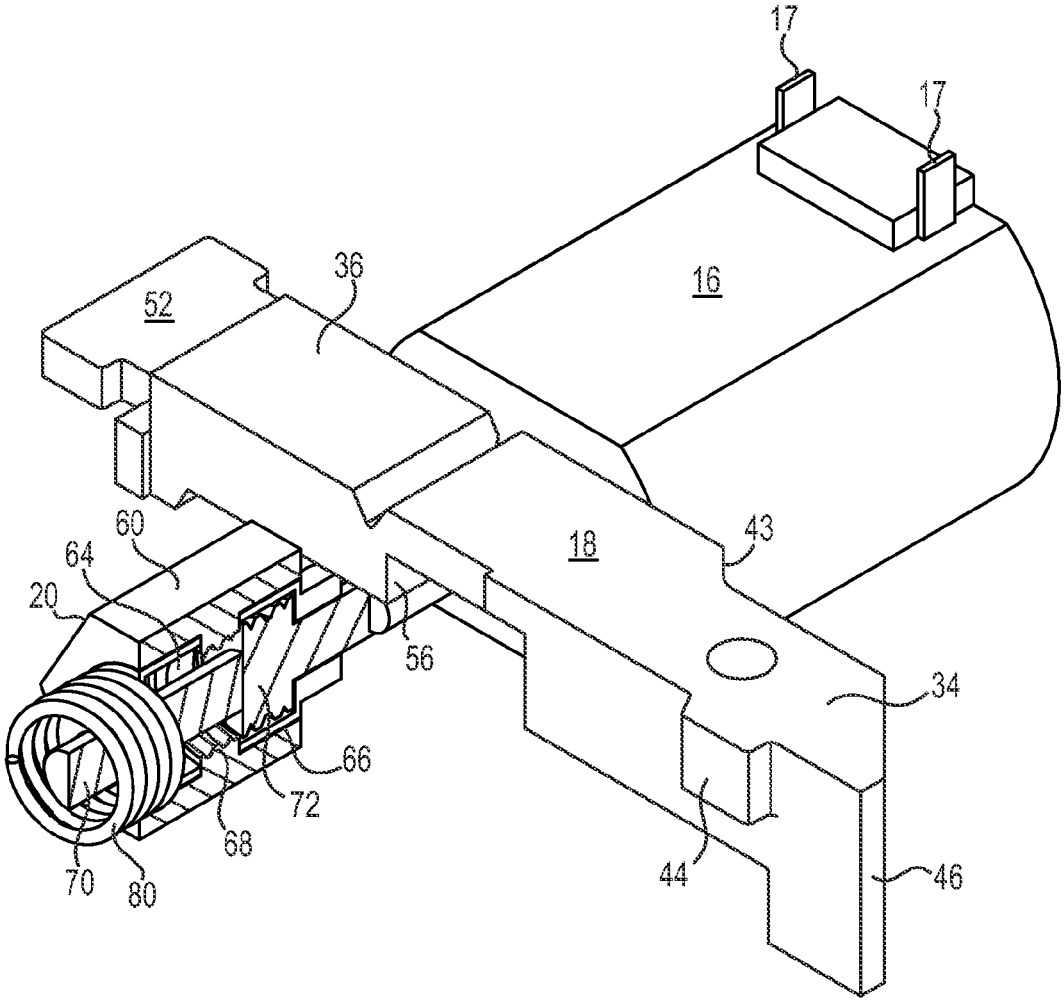
FIG. 4 is a perspective view of the locking mechanism of the invention providing detail of the locking mechanism in the unlocked position.
Figure 5:
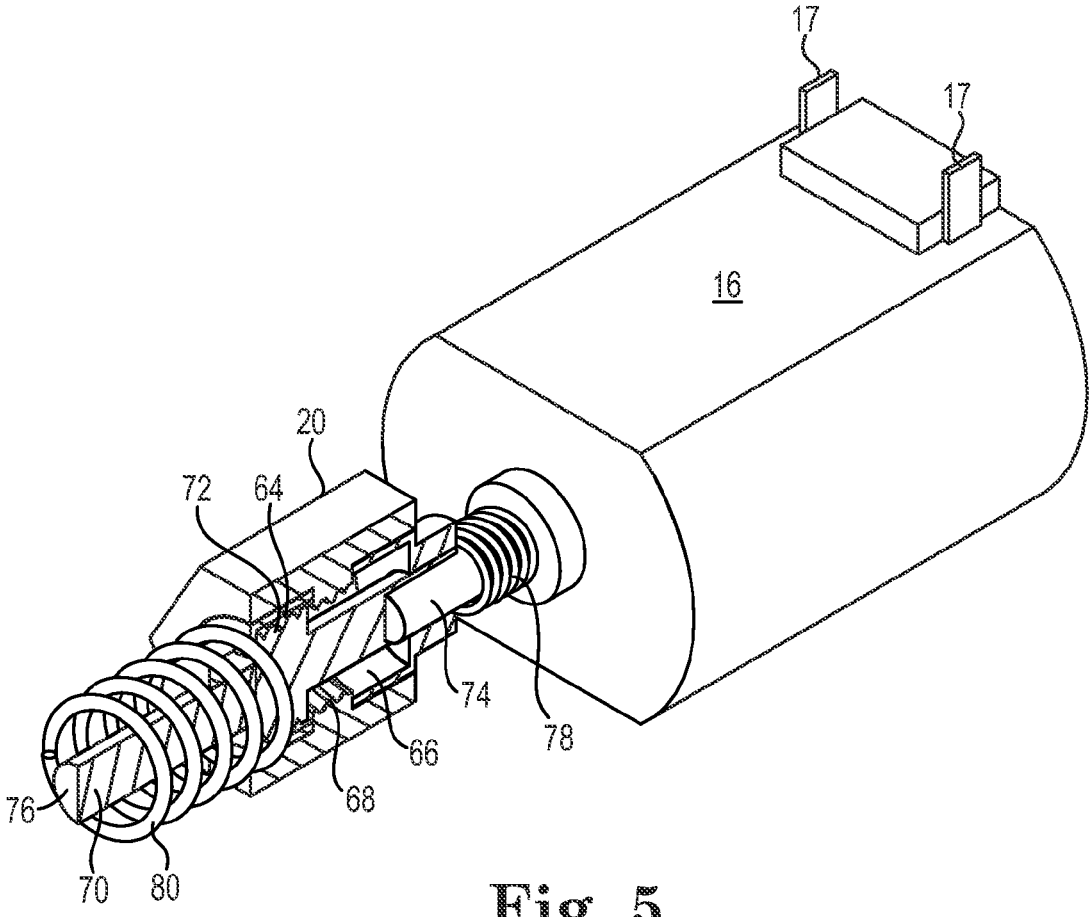
FIG. 5 is a perspective view of the locking mechanism of the invention showing detail of the blocking element in the locked position.

Blocking element 20 includes first and second internal chambers 64, 66 and threaded internal annular ring 68 thereinbetween. Blocking element 20 is coupled to and received on blocking element shaft 70. Blocking element shaft 70 includes annular threaded projection 72 positioned in between first and second ends 74, 76. First end 74 is operably, rotatably coupled to actuating device 16. Second end 76 is operably coupled to housing 12 such that actuation by actuating device 16 permits shaft 70 to freely rotate. In the locked position (as best seen in FIG. 5) annular threaded projection 72 is received in first chamber 64 of blocking element 20. In the unlocked position (as best seen in FIG. 4) annular threaded projection 72 is received in second chamber 66. Shaft 70 receives first and second springs 78, 80, respectively.

Referring now to FIGS. 1 through 5, in the unlocked position, second spring 80 biases blocking element 20 toward annular threaded projection 72 such that annular threaded projection 72 contacts but does not engage the threads of internal annular ring 68. Upon actuation, shaft 70 rotates the threaded annular projection 72 such that it engages the threads of internal annular ring 68 which drives blocking element 20 in a linear manner into first chamber 64 or, as those of ordinary skill in the art will appreciate, into the locked position. In the locked position, first spring 78 is in the "loaded" position while second spring 80 is released. First spring 78 thus biases blocking element 20 toward annular threaded projection 72 such that annular threaded projection 72 contacts but does not engage the threads of internal annular ring 68. Upon actuation, shaft 70 once again rotates the threaded annular projection 72 such that it engages the threads of internal annular ring 68, which drives blocking element 20 in a linear manner back into second chamber 66 or, as those of ordinary skill in the art will appreciate, into the unlocked position. Importantly, when the correct combination is entered, a signal is transmitted to the blocking element 20 which causes blocking element 20 to move to the unblocked position. Blocking element 20 remains in the unblocked position until the user rotates dial 26 to move the lock into the locked position. Actuator 16 does not hold blocking element 20 in the unblocked position so that power consumption is reduced.

In operation and to open the locked safe door, a user enters a combination into the key pad on dial 26. A signal is transmitted to a circuit board (not shown) located within housing 12. If the combination entered is recognized as the correct combination, a signal is sent to actuating device 16 which in turn causes blocking element 20 to move from the locked position to the unlocked position, by the mechanism previously described. The user then turns dial 26 which causes shaft 24 to rotate cam 14 from a first position in which first blocking side 30 blocks angled portion 40 of locking lever 18 to a second position in which second blocking side 32 abuts side facing 42 of locking lever 18. The user continues to turn dial 26 and locking lever 18 retracts into the open or unlocked position as post 46 slidingly retracts in housing recess 48. Rectilinear bolt 28 is now in the open position.

When a user wants to again lock the safe, the user manually rotates dial 26 which in turn causes shaft 24 to commence rotating cam 14 from the second position to the first position. First blocking side 30 of cam 14 engages angled portion 40 of locking lever and propels it axially forward. The locking lever 18 passes a magnet which activates a switch (not shown) on the circuit board which in turn sends a signal to actuator 16 to move blocking element 20 into the blocked position. Tab 44 slides within slot 50 until tab 44 abuts and engages first side wall 49. Electronic lock 10 is now in the locked position Although the present invention has been described with reference to exemplary embodiments, workers skilled in the art will recognize that changes may be made in form and detail without departing from the spirit and scope of the invention.

What is claimed is:

1. An electromechanical lock comprising:

a housing;

a locking lever slidably received by the housing;

a blocking element positioned adjacent the locking lever, the blocking element rotatably movable between a first blocking element position that engages the locking lever and a second blocking element position that disengages the locking lever, the blocking element including a first non-threaded internal chamber, a second non-threaded internal chamber and a threaded internal annular ring positioned therebetween, said threaded internal annular ring having an axial length;

a rotatable shaft received through said blocking element, said rotatable shaft having a first non-threaded portion and a second non-threaded portion with an annular threaded portion positioned therebetween, said annular threaded portion having an axial length substantially equal to the axial length of the threaded internal annular ring;

a first spring co-axially surrounding said first non-threaded portion of the shaft and a second spring coaxially surrounding said second non-threaded portion of the shaft, said first and second springs structured to bias the blocking element toward the annular threaded portion of the shaft in the respective first and second blocking element positions; and an actuating device operable to control movement of the blocking element between the first and second positions.

2. The electromechanical lock of claim 1, wherein the annular threaded portion of the shaft is disposed within the first internal chamber in the first blocking element position and within the second internal chamber in the second blocking element position.

3. The electromechanical lock of claim 2, wherein rotation of the shaft causes engagement of the annular threaded portion with the threaded internal annular ring of the blocking element thereby driving the blocking element in an axial direction between the first and second positions.

4. The electromechanical lock of claim 1, further comprising a rotatable cam disposed within the housing that operably engages the locking lever to control movement of the locking lever between a locked position wherein a locking bolt portion protrudes from the housing and an unlocked position wherein the locking bolt portion retracts into the housing.

5. The electromechanical lock of claim 4, wherein the rotatable cam includes a blocking side that engages a cam engaging end of the locking lever in the locked position and rotates to disengage the cam engaging end of the locking lever in the unlocked position.

6. The electromechanical lock of claim 5, wherein the blocking side and the cam engaging end each comprise an angled surface.

7. The electromechanical lock of claim 6, further comprising a spindle shaft operably coupled to the cam for controlling rotation of the cam.

8. The electromechanical lock of claim 5, wherein the locking lever includes a tab member that is slidable within a tab slot in the housing.

9. An electromechanical lock comprising:

a housing;

a locking lever slidable within the housing;

a blocking element positioned adjacent the locking lever, the blocking element movable between a first blocking element position that blocks linear movement of the locking lever and a second blocking element position that allows linear movement of the locking lever, the blocking element including a first non-threaded internal chamber, a second non-threaded internal chamber and a threaded internal annular ring positioned therebetween, said threaded internal annular ring having an axial length;

a rotatable shaft received through said blocking element, said rotatable shaft having a first non-threaded portion and a second non-threaded portion with an annular threaded portion positioned therebetween, said annular threaded portion having an axial length substantially equal to the axial length of the threaded internal annular ring;

an actuating device operable to control movement of the blocking element between the first and second positions, the actuating device operably coupled to said rotatable shaft, said rotatable shaft structured to engages the blocking element to drive linear movement between the first and second positions;

a first spring co-axially surrounding said first non-threaded portion of the shaft and a second spring coaxially surrounding said second non-threaded portion of the shaft said first and second springs structured to bias the blocking element toward the annular threaded portion of the shaft in the respective first and second blocking element positions; and a rotatable cam disposed within the housing that operably engages the locking lever to control movement of the locking lever.

10. The electromechanical lock of claim 9, wherein the annular threaded portion of the shaft is disposed within the first internal chamber in the first blocking element position and within the second internal chamber in the second blocking element position.

11. The electromechanical lock of claim 10, wherein the rotatable cam controls movement of the locking lever between a locked position wherein a locking bolt portion of the locking lever protrudes from the housing and an unlocked position wherein the locking bolt portion retracts into the housing.

12. The electromechanical lock of claim 11, wherein the locking lever includes a tab member that is slidable within a tab slot in the housing, the tab slot defined by a first blocking side wall on a first end and a second blocking side wall on a second end.

13. A method of operating an electromechanical lock comprising:

providing the electromechanical lock of claim 1 or 9;

entering a combination into a key pad;

transmitting a signal to a circuit board operably coupled to the electromechanical lock indicating a correct combination;

causing the actuating device to move the blocking element from the first position to the second position upon entry of a correct combination; and rotating a lock dial to retract the locking lever into an open position.

14. The method of claim 13, wherein the blocking element includes a first internal chamber and a second internal chamber separated by a threaded internal annular ring, and wherein the actuating device includes a shaft having an annular threaded portion that is disposed within the first internal chamber in the first blocking element position and within the second internal chamber in the second blocking element position.

15. The method of claim 14, wherein operating the actuating device to move the blocking element from the first position to the second position comprises rotating the shaft to cause engagement between the annular threaded portion and the threaded internal annular ring.

16. The method of claim 15 wherein the blocking element remains in the second position until a user rotates the lock dial to advance the locking lever into a locked position.

* * * * *